US012193509B2

(12) United States Patent
Qiu et al.

(10) Patent No.: US 12,193,509 B2
(45) Date of Patent: Jan. 14, 2025

(54) CARTRIDGE AND ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Zhencai Zhou, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 853 days.

(21) Appl. No.: 17/239,716

(22) Filed: Apr. 26, 2021

(65) Prior Publication Data

US 2021/0244102 A1 Aug. 12, 2021

Related U.S. Application Data

(63) Continuation-in-part of application No. PCT/CN2019/110690, filed on Oct. 12, 2019.

(30) Foreign Application Priority Data

Oct. 26, 2018 (CN) ..... 201811256403.7
Oct. 26, 2018 (CN) ..... 201811256405.6

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/44* (2020.01); *A24F 40/46* (2020.01)

(58) Field of Classification Search
CPC ..... A24F 40/485; A24F 40/10; A24F 40/46; A24F 40/44; A24F 40/42
See application file for complete search history.

(56) References Cited

FOREIGN PATENT DOCUMENTS

CN 104824846 A 8/2015
CN 104939320 A 9/2015
(Continued)

OTHER PUBLICATIONS

English machine translation of CN 10820935 A; Changzhou; 33 pages; Jun. 29, 2018. (Year: 2018).*
(Continued)

*Primary Examiner* — Linda L Gray
(74) *Attorney, Agent, or Firm* — Andrew C. Cheng

(57) ABSTRACT

A cartridge includes a cartridge shell, and a movable structure and an atomizing structure received in the cartridge shell. The cartridge shell is provided with a vent hole. The movable structure includes an isolation guiding tube received in the cartridge shell and a movable tube at least partially disposed in the isolation guiding tube. The movable tube includes an operating portion and a shielding portion connected to a lower end of the operating portion. The operating portion is located in the isolation guiding tube and one end of the operating portion extends out from the vent hole. The atomizing structure is provided with a liquid inlet hole. The shielding portion is movably sleeved on the atomizing structure to shield or expose the liquid inlet hole, to cause the liquid inlet hole to be isolated from or in communication with the liquid storage chamber.

17 Claims, 11 Drawing Sheets

(51) Int. Cl.

| | |
|---|---|
| ***A24F 40/42*** | (2020.01) |
| ***A24F 40/44*** | (2020.01) |
| ***A24F 40/46*** | (2020.01) |

(56) References Cited

FOREIGN PATENT DOCUMENTS

| | | | |
|---|---|---|---|
| CN | 206687179 | U | 12/2017 |
| CN | 107865463 | A | 4/2018 |
| CN | 108208935 | A | 6/2018 |
| CN | 209314959 | U | 8/2019 |
| CN | 209489498 | U | 10/2019 |
| EP | 3179829 | A2 | 6/2017 |
| EP | 3179829 | A3 | 10/2017 |
| WO | 2017197584 | A1 | 11/2017 |
| WO | 2018133267 | A1 | 7/2018 |

OTHER PUBLICATIONS

The extended European Search Report of EP Application No. 19876633.9 issued on May 24, 2022.
International Search Report of PCT Patent Application No. PCT/CN2019/110690 issued on Jan. 16, 2020.

* cited by examiner

CARTRIDGE AND ELECTRONIC CIGARETTE

CROSS-REFERENCE TO RELATED APPLICATIONS

This application is a continuation-in-part of International patent application No. PCT/CN2019/110690, filed on Oct. 12, 2019, entitled "cartridge and electronic cigarette", which claims priority to Chinese patent application Nos. 201811256405.6 and 201811256403.7, filed on Oct. 26, 2018. All of the aforementioned applications are hereby incorporated by reference in their entireties.

TECHNICAL FIELD

The present disclosure relates to the technical field of simulated smoking, and more particularly, relates to a cartridge and an electronic cigarette having the cartridge.

BACKGROUND

At present, electronic cigarettes have become a relatively mature smoking substitute in the market. The battery supplies power to the heating unit of the cartridge, so that the heating unit is electrically driven to heat the e-liquid to generate smoke for users to inhale.

In the traditional liquid-fillable atomizer, the liquid inlet hole of the atomizing shell is usually in communication with the liquid storage chamber. When the electronic cigarette is not used for a long time, the e-liquid in the liquid storage chamber may enter the atomizing shell via the liquid inlet hole, the liquid absorbing member in the atomizing shell may gradually absorb the e-liquid entering into the atomizing shell. The inner cavity of the atomizing shell is usually in communication with the outside world, and the e-liquid absorbed by the liquid absorbing member volatilizes to the outside world, and long-term contact with the air may cause the e-liquid to deteriorate. Additionally, the liquid absorbing member may repeatedly absorb the e-liquid entering into the atomizing shell, when the user uses the electronic cigarette again, part of the e-liquid in the liquid storage chamber has been absorbed by the liquid absorbing member, and the amount of e-liquid in the liquid storage chamber is reduced. As a result, it is difficult to store the e-cigarette in the liquid storage chamber, and even causes a waste of money.

SUMMARY

In view of the above, the present disclosure provides a cartridge and an electronic cigarette having the cartridge to solve the above-mentioned problems.

A first aspect of the present disclosure provides a cartridge. The cartridge includes a cartridge shell, and a movable structure and an atomizing structure received in the cartridge shell. An inner cavity of the cartridge shell forms a liquid storage chamber. The cartridge shell is provided with a vent hole. The movable structure includes an isolation guiding tube received in the cartridge shell and a movable tube at least partially disposed in the isolation guiding tube. The movable tube includes an operating portion and a shielding portion connected to a lower end of the operating portion. The operating portion is located in the isolation guiding tube and one end of the operating portion extends out from the vent hole. The atomizing structure is provided with a liquid inlet hole capable of being communicated with the liquid storage chamber. The shielding portion is movably sleeved on the atomizing structure to shield or expose the liquid inlet hole, to cause the liquid inlet hole to be isolated from or in communication with the liquid storage chamber.

Further, the atomizing structure includes an atomizing shell, and a heating member and a liquid absorbing member received in the atomizing shell. The liquid inlet hole is defined in the atomizing shell. The e-liquid is absorbed by the liquid absorbing member from the liquid inlet hole and supplied to the heating member.

Further, the shielding portion is provided with a cutting groove, and the isolation guiding tube is provided with a cutting portion facing the cutting groove and matching with the cutting groove.

Further, the isolation guiding tube includes a connecting pipe abutting against an inner wall of the cartridge shell and a receiving portion connected to a lower end of the connecting pipe. The receiving portion extends firstly radially outwards from the connecting pipe and then extends downwards. An inner cavity of the connecting pipe is in communication with the vent hole.

Further, the atomizing shell provides an atomizing chamber therein, and the atomizing chamber is in communication with the inner cavity of the connecting pipe and the vent hole.

Further, an upper end of the cartridge shell is provided with a liquid injection hole in communication with the liquid storage chamber. An e-liquid plug is provided in the liquid injection hole for sealing the liquid injection hole.

Further, the cartridge shell is provided with an air inlet hole in communication with the outside.

Further, the vent hole is provided at an upper end of the cartridge shell. The isolation guiding tube includes a connecting pipe, an inner cavity of the connecting pipe is in communication with the vent hole, the operating portion is received in the connecting pipe, and an upper end of the operating portion extends out of the cartridge shell from the vent hole.

Further, a cutting portion is provided at a lower end of the connecting pipe, and a cutting groove is provided at an upper end of the shielding portion corresponding to the cutting portion. When the upper end of the operating portion is pulled to move upwardly, the operating portion drives the shielding portion to move upwards, an inner bottom wall of the cutting groove resists the cutting portion to separate the shielding portion from the operating portion.

Further, the isolation guiding tube further includes a receiving portion connected to the lower end of the connecting pipe. The receiving portion extends firstly radially outwards from the connecting pipe and then extends downwards. The shielding portion is received in the receiving portion after the shielding portion is separated from the operating portion.

Further, an outer surface of the shielding portion is protruded to form an abutting portion. The abutting portion resists an inner surface of the receiving portion so as to fix the shielding portion relative to the receiving portion after the shielding portion is separated from the operating portion.

Further, an inner surface of the shielding portion is protruded to form an abutting portion. The abutting portion resists an outer surface of the connecting pipe so as to fix the shielding portion relative to the connecting pipe after the shielding portion is separated from the operating portion.

Further, the cartridge further includes a cartridge plug connected to a lower end of the cartridge shell. The cartridge plug and a lower end of the shielding portion are integrally formed. An annular cut is formed along a circumference of the shielding portion at the junction of the cartridge plug and the shielding portion. When the upper end of the operating portion is pulled to move upwardly, the operating portion drives the shielding portion to move upwards so that the shielding portion is separated from the cartridge plug from the annular cut.

Further, an inner wall of the cartridge shell adjacent to the vent hole protrudes downwardly along an axial direction of the cartridge shell to form a limiting portion. The connecting pipe is at let partially disposed in the limiting portion and abuts against an inner surface of the limiting portion.

Further, the cartridge further includes a sealing structure. The sealing structure includes a cartridge plug connected to one end of the cartridge shell. The cartridge plug seals one end of the liquid storage chamber. The atomizing structure is at least partially disposed on the cartridge plug.

Further, the sealing structure further includes a tail cap connected to the cartridge plug, an airway plug received in the tail cap, and electrode contact members mounted to the tail cap. The cartridge plug is sleeved on the atomizing shell and connected to the shielding portion.

Further, the tail cap includes a base provided at the lower end of the cartridge shell and a cap body provided on the base and connected to the cartridge plug. The base is provided with a plurality of cutouts. The cap body is located in the cartridge plug. The cap body is provided with a plurality of guiding holes in communication with the cutouts. The airway plug is received in the cap body. The airway plug is provided with a plurality of airway holes in communication with the guiding holes.

A second aspect of the present disclosure provides an electronic cigarette. The electronic cigarette includes a battery device and a cartridge according to the first aspect of the present disclosure. The cartridge is electrically connected to the battery device.

A third aspect of the present disclosure provides a cartridge. The cartridge includes a cartridge shell, and a movable structure and an atomizing structure received in the cartridge shell. An inner cavity of the cartridge shell forms a liquid storage chamber. The cartridge shell is provided with a vent hole. The movable structure includes an isolation guiding tube received in the cartridge shell and a movable tube at least partially disposed in the isolation guiding tube. The movable tube includes an operating portion and a shielding portion connected to a lower end of the operating portion. The operating portion is located in the isolation guiding tube and one end of the operating portion extends out from the vent hole. The atomizing structure is provided with a liquid inlet hole capable of being communicated with the liquid storage chamber. The shielding portion is movably sleeved on the atomizing structure to shield or expose the liquid inlet hole, to cause the liquid inlet hole to be isolated from or in communication with the liquid storage chamber. The shielding portion is able to irreversibly switch from a first state to a second state by operating the operating portion, wherein:

in the first state, the shielding portion is sleeved on the atomizing structure to shield the liquid inlet hole of the atomizing structure, and the liquid inlet hole is isolated from the liquid storage chamber; and in the second state, the shielding portion and the operating portion are separated, the shielding portion moves relative to the atomizing structure to expose the liquid inlet hole, and the liquid inlet hole is in communication with the liquid storage chamber.

Further, the atomizing structure includes an atomizing shell, and a heating member and a liquid absorbing member received in the atomizing shell. The liquid inlet hole is defined in the atomizing shell. The e-liquid is absorbed by the liquid absorbing member from the liquid inlet hole and supplied to the heating member.

Further, the shielding portion is provided with a cutting groove, and the isolation guiding tube is provided with a cutting portion facing the cutting groove and matching with the cutting groove.

Further, the isolation guiding tube includes a connecting pipe abutting against an inner wall of the cartridge shell and a receiving portion connected to a lower end of the connecting pipe. The receiving portion extends radially outwards from the connecting pipe and then extends downwards. An inner cavity of the connecting pipe is in communication with the vent hole.

Further, the atomizing shell provides an atomizing chamber therein, and the atomizing chamber is in communication with the inner cavity of the connecting pipe and the vent hole.

Further, an upper end of the cartridge shell is provided with a liquid injection hole in communication with the liquid storage chamber. An e-liquid plug is provided in the liquid injection hole for sealing the liquid injection hole.

Further, the cartridge shell is provided with an air inlet hole in communication with the outside.

Further, the cartridge further includes a sealing structure. The sealing structure includes a cartridge plug connected to one end of the cartridge shell. The cartridge plug seals one end of the liquid storage chamber. The atomizing structure is at least partially disposed on the cartridge plug.

Further, the sealing structure further includes a tail cap connected to the cartridge plug, an airway plug received in the tail cap, and electrode contact members mounted to the tail cap. The cartridge plug is sleeved on the atomizing shell and connected to the shielding portion.

Further, the tail cap includes a base provided at the lower end of the cartridge shell and a cap body provided on the base and connected to the cartridge plug. The base is provided with a plurality of cutouts. The cap body is located in the cartridge plug. The cap body is provided with a plurality of guiding holes in communication with the cutouts. The airway plug is received in the cap body. The airway plug is provided with a plurality of airway holes in communication with the guiding holes.

A fourth aspect of the present disclosure provides an electronic cigarette. The electronic cigarette includes a battery device and a cartridge according to the third aspect of the present disclosure. The cartridge is electrically connected to the battery device.

In the cartridge of the present disclosure, since the movable structure includes an isolation guiding tube received in the cartridge shell and a movable tube at least partially disposed in the isolation guiding tube, the movable tube includes an operating portion and a shielding portion, the operating portion is received in the isolation guiding tube and one end of the operating portion extends out from the vent hole, the atomizing structure is provided with a liquid inlet hole capable of being communicated with the liquid storage chamber, the shielding portion is movably sleeved on the atomizing structure to shield or expose the liquid inlet hole, so that the liquid inlet hole is isolated from or in communication with the liquid storage chamber. When the user does not use the electronic cigarette, the shielding portion is sleeved on the atomizing shell to shield the liquid inlet hole. When the user uses the electronic cigarette, the shielding portion and the operating portion are separated, and the shielding portion moves relative to the atomizing shell to expose the liquid inlet hole, so that the liquid inlet hole is in communication with the liquid storage chamber. The electronic cigarette of the present disclosure can realize the isolation of the e-liquid from the cotton when the user does not use the electronic cigarette, thereby facilitating the storage of the e-liquid and preventing the e-liquid from deteriorating.

Figure 1:
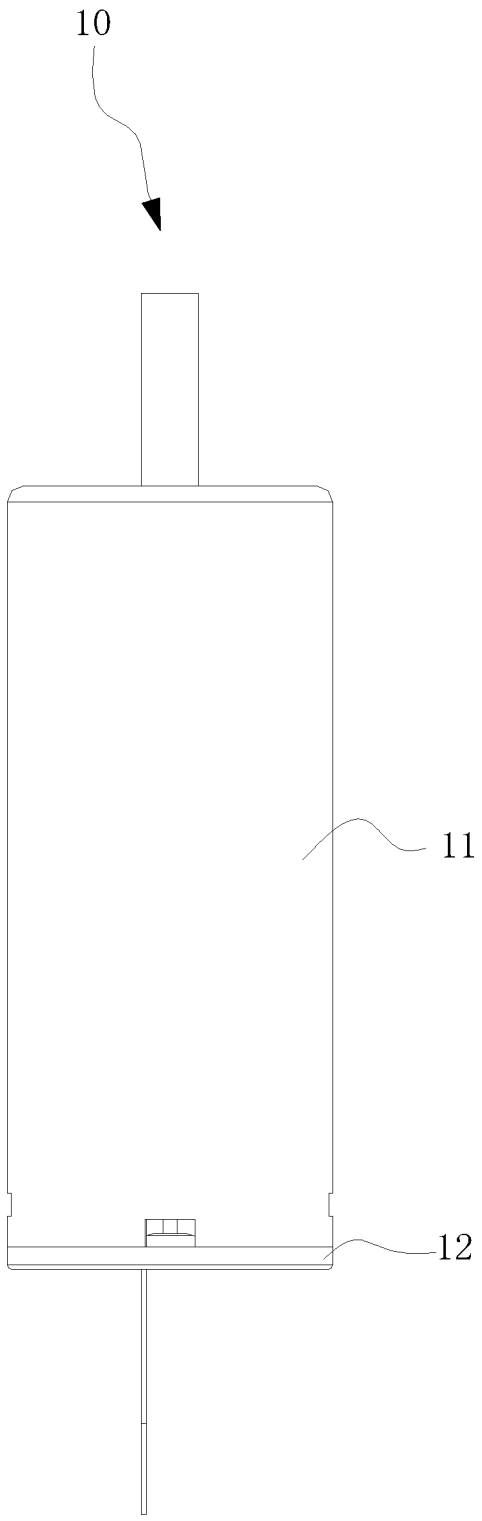
FIG. 1 is a schematic diagram of the structure of the cartridge according to the first embodiment of the present disclosure.

The various components and reference numerals in the drawings are as follows:

| | |
|---|---|
| cartridge 10 | cartridge main body 11 |
| movable structure 112 | atomizing structure 113 |
| liquid injection hole 1113 | air inlet hole 1114 |
| isolation guiding tube 1121 | movable tube 1122 |
| connecting section 1125 | cutting portion 1126 |
| cutting groove 1129 | abutting portion 1130 |
| liquid absorbing member 1133 | liquid inlet hole 1134 |
| airway plug 123 | electrode contact member 124 |
| cap body 1222 | cutout 1223 |
| sealing structure 12 | cartridge shell 111 |
| liquid storage chamber 1111 | vent hole 1112 |
| limiting portion 1115 | e-liquid plug 1116 |
| connecting pipe 1123 | receiving portion 1124 |
| operating portion 1127 | shielding portion 1128 |
| atomizing shell 1131 | heating member 1132 |
| cartridge plug 121 | tail cap 122 |
| receiving hole 1211 | base 1221 |
| airway hole 1231 | annular cut 1212 |

DETAILED DESCRIPTION OF PREFERRED EMBODIMENTS

In order to facilitate the understanding of the present disclosure, the present disclosure will be described in details with reference to the accompanying drawings. Preferred embodiments of the present disclosure are given in the drawings. However, the present disclosure can be realized in many different forms and is not limited to the embodiments described herein. On the contrary, the purpose of providing these embodiments is to make a more thorough and comprehensive understanding of the disclosed contents of the present disclosure.

It should be noted that when an element is referred to as being "fixed to" another element, it may be directly on the other element or intervening elements may be present. When an element is considered to be "connected" to another element, it can be directly connected to the other element or intervening elements may also be present.

Unless defined otherwise, all technical and scientific terms used herein have the same meaning as commonly understood by one of ordinary skill in the art to which this disclosure belongs. The terms used herein in the description of the present disclosure are only for the purpose of describing specific embodiments, and are not intended to limit the present disclosure. The term "and/or" as used herein includes any and all combinations of one or more of the associated listed items.

First Embodiment

Please refer to FIG. 1, the first embodiment of the present disclosure provides an electronic cigarette, the electronic cigarette includes a cartridge 10 and a battery device (not shown). The cartridge 10 is electrically connected to the battery device, and the cartridge 10 heats the e-liquid under the electric driving of the battery device, so that the e-liquid is atomized into smoke.

The cartridge 10 includes a cartridge main body 11 and a sealing structure 12 mounted at the lower end of the cartridge main body 11. Please also refer to FIGS. 2-7, the cartridge main body 11 includes a cartridge shell 111, and a movable structure 112 and an atomizing structure 113 received in the cartridge shell 111. In the embodiment, the sealing structure 12 and the cartridge main body 11 are independent parts; alternatively, in another embodiment not shown, the sealing structure 12 can be integrally formed with the cartridge shell 111.

In one embodiment, the cartridge shell 111 is substantially cylindrical with an opening at a bottom end thereof. The inner cavity of the cartridge shell 111 forms a liquid storage chamber 1111. The upper end of the cartridge shell 111 is provided with a vent hole 1112 for one end of the movable structure 112 to extend through the upper end of the cartridge shell 111, and a liquid injection hole 1113 in communication with the liquid storage chamber 1111. The side wall of the cartridge shell 111 is provided with an air inlet hole 1114.

In another embodiment not shown, the cartridge shell 111 does not have the liquid injection hole 1113, but a pre-encapsulation method is used to inject the e-liquid into the cartridge 10 from the lower end of the cartridge shell 111. After the e-liquid is consumed, the cartridge 10 is discarded as a whole, that is, the cartridge 10 cannot be refilled. The inner wall of the cartridge shell 111 adjacent to the vent hole 1112 protrudes downwardly along the axial direction of the cartridge shell 111 to form a limiting portion 1115 used for abutting against the movable structure 112. An e-liquid plug 1116 is provided in the liquid injection hole 1113. In this embodiment, the e-liquid plug 1116 is made of rubber material. It can be understood that, in other embodiments not shown, the e-liquid plug 1116 may also be made of other materials with good sealing property such as silicone. After the user fills the liquid storage chamber with e-liquid through the liquid injection hole 1113, the e-liquid plug 1116 is installed in the liquid injection hole 1113. The e-liquid plug 1116 can seal the liquid injection hole 1113 and prevent the e-liquid in the liquid storage chamber 1111 from leaking via the liquid injection hole 1113.

Referring to FIGS. 2 to 5, an air inlet hole 1114 is provided at one side of the lower end of the cartridge shell 111, and external air can enter the cartridge 10 via the air inlet hole 1114. The number of the air inlet hole 1114 can be N, wherein N is a natural number greater than or equal to one, and the distance between the air inlet holes 1114 depends on the specific design. It can be understood that, in other embodiments not shown, the air inlet hole 1114 may also be defined at the top, at one side of the upper end, or at the bottom of the cartridge shell 111.

The movable structure 112 includes an isolation guiding tube 1121 at least partially disposed in the limiting portion 1115 and a movable tube 1122 movably disposed in the isolation guiding tube 1121. The isolation guiding tube 1121 has a structure with both ends being opened.

Figure 2:
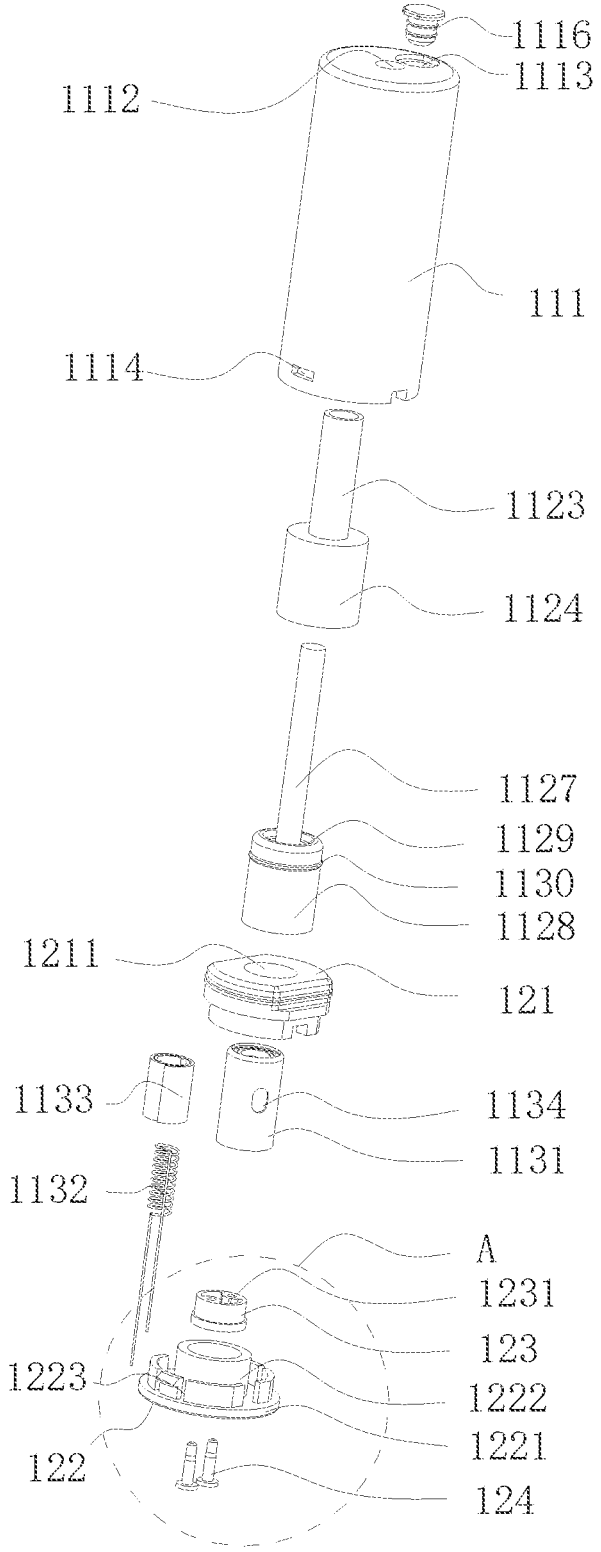
FIG. 2 is an exploded view of the cartridge shown in FIG. 1.
Figure 3:
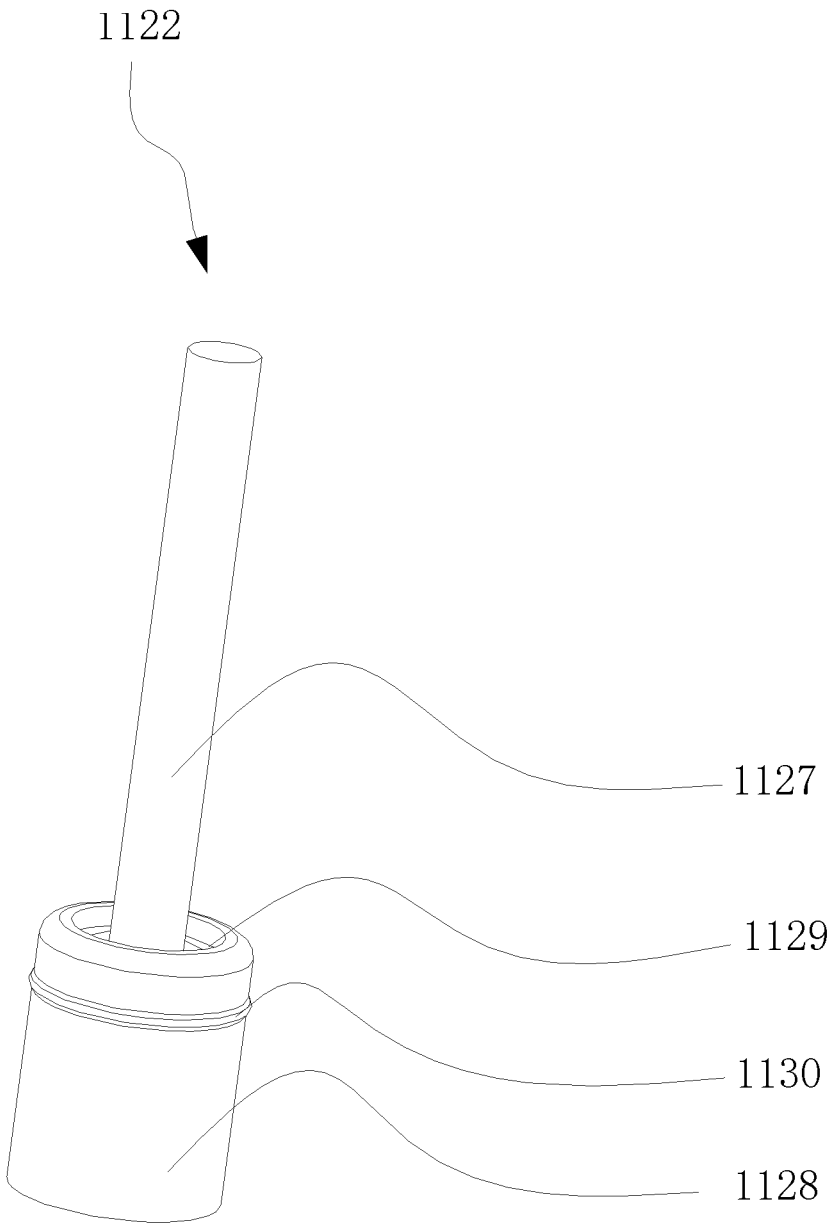
FIG. 3 is a schematic diagram of the structure of the movable tube of the cartridge shown in FIG. 2.
Figure 4:
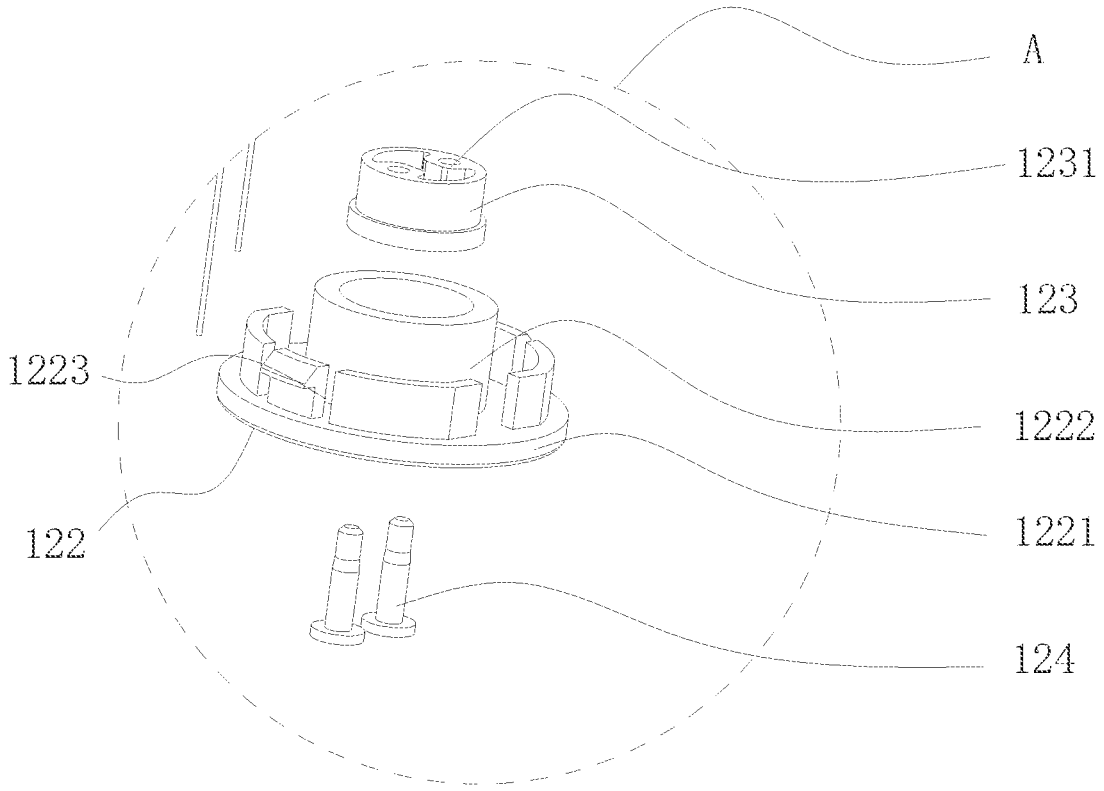
FIG. 4 is a partially enlarged view of the portion A in the cartridge shown in FIG. 2.
Figure 5:
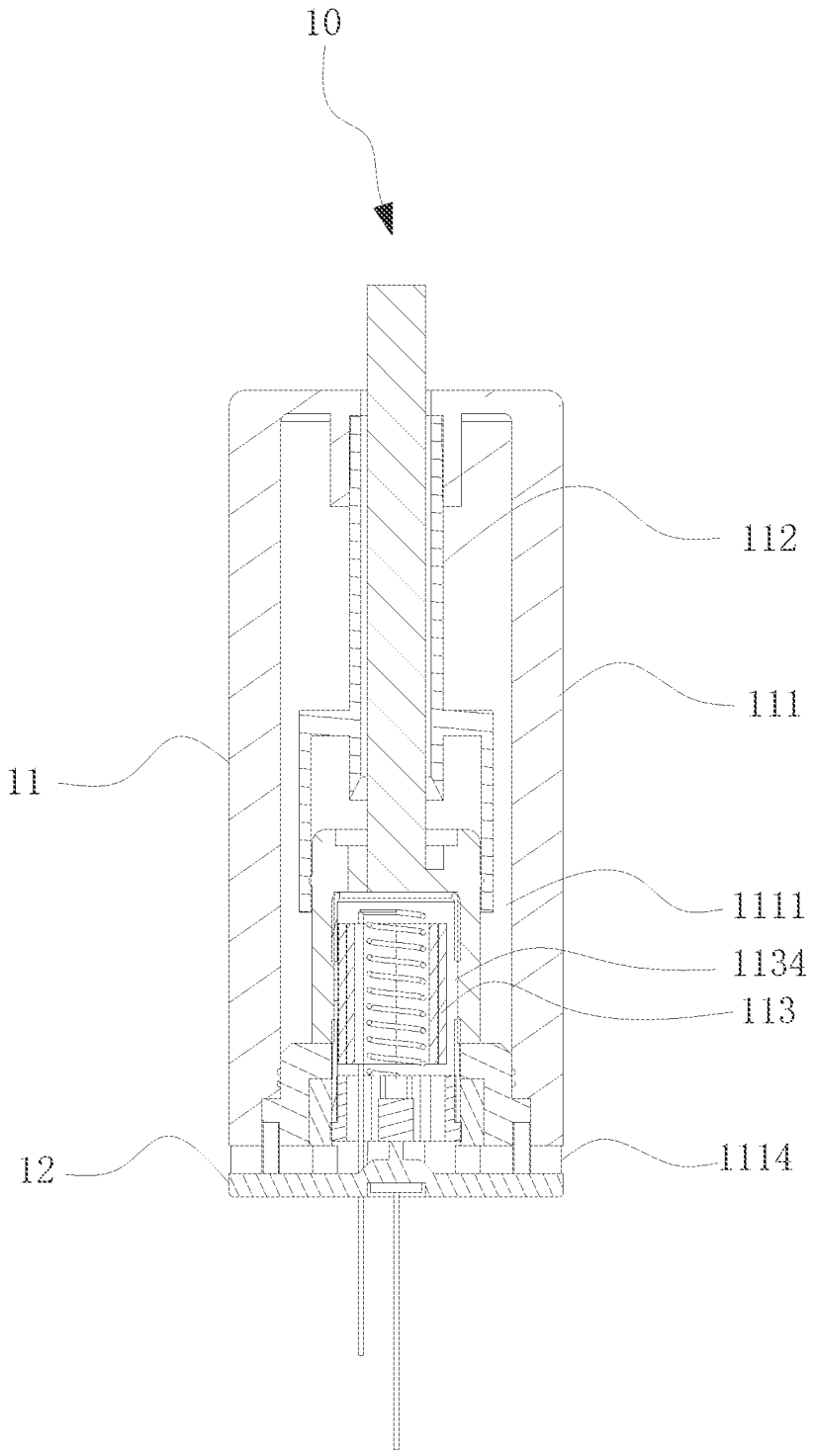
FIG. 5 is a schematic structural diagram of the cartridge shown in FIG. 1 in one state.
Figure 6:
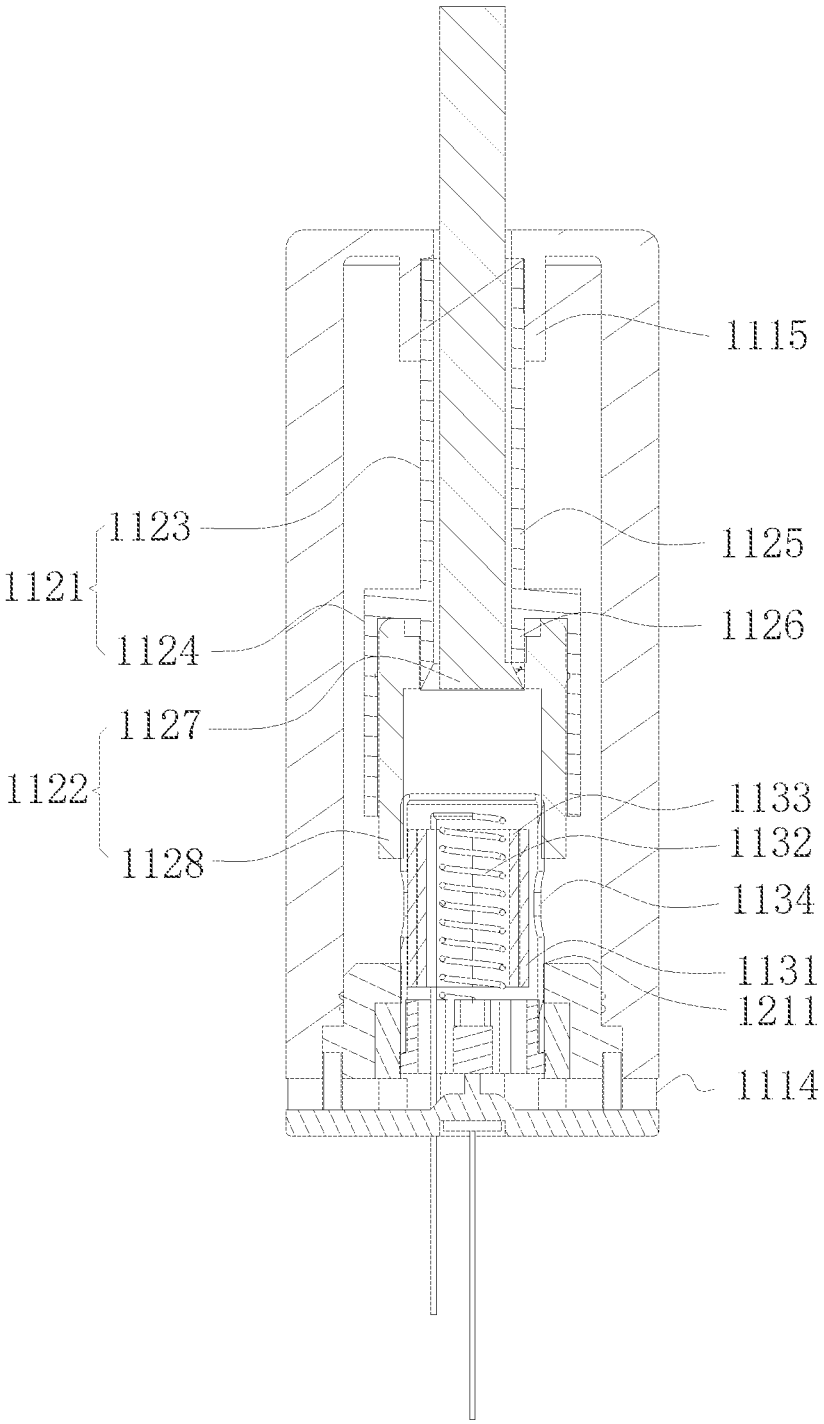
FIG. 6 is a schematic structural diagram of the cartridge shown in FIG. 1 in another state.
Figure 7:
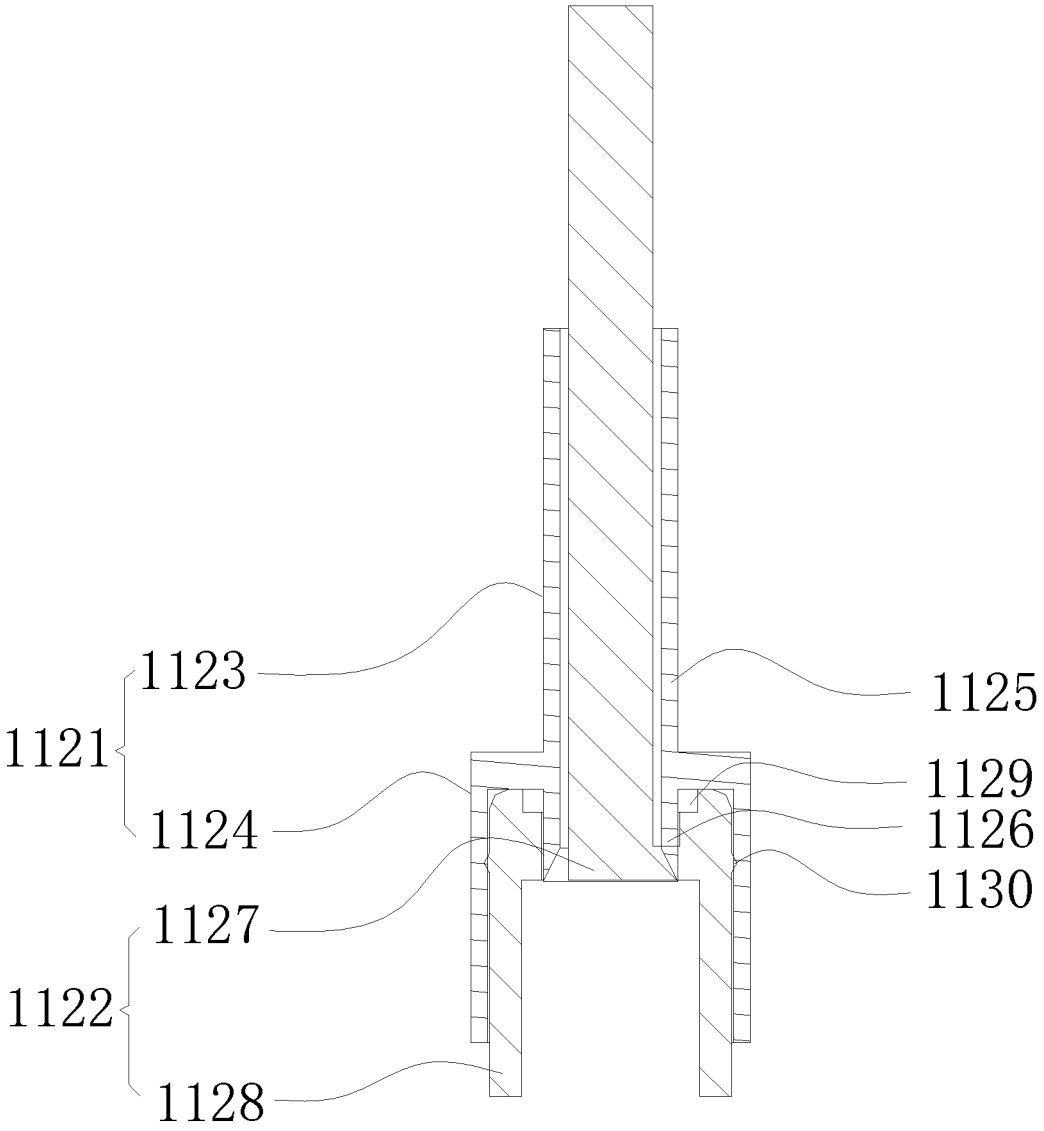
FIG. 7 is a schematic diagram of the cooperation relationship between the isolation guiding tube and the movable tube of the cartridge shown in FIG. 6.
Figure 8:
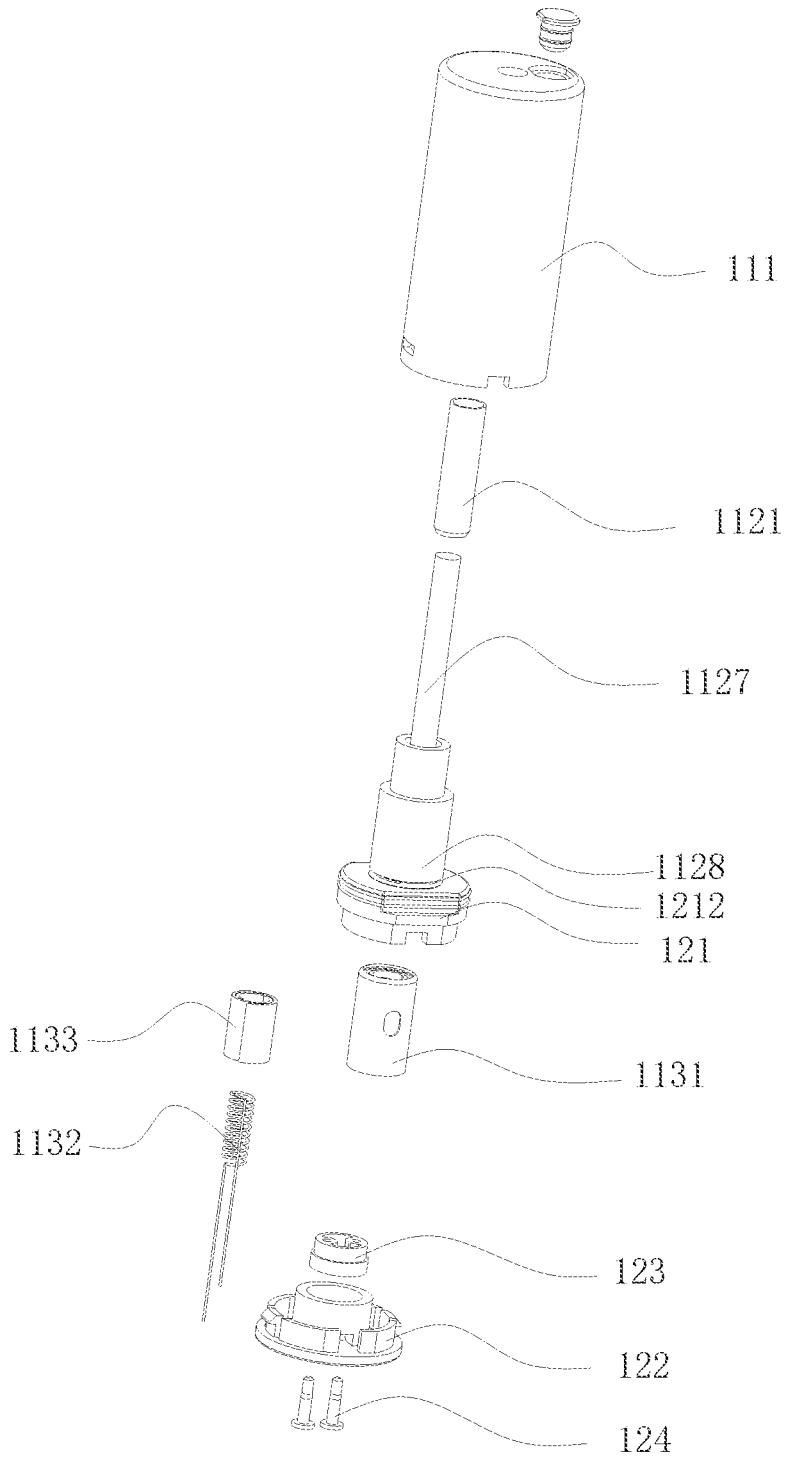
FIG. 8 is an exploded view of the cartridge according to the second embodiment of the present disclosure.
Figure 9:
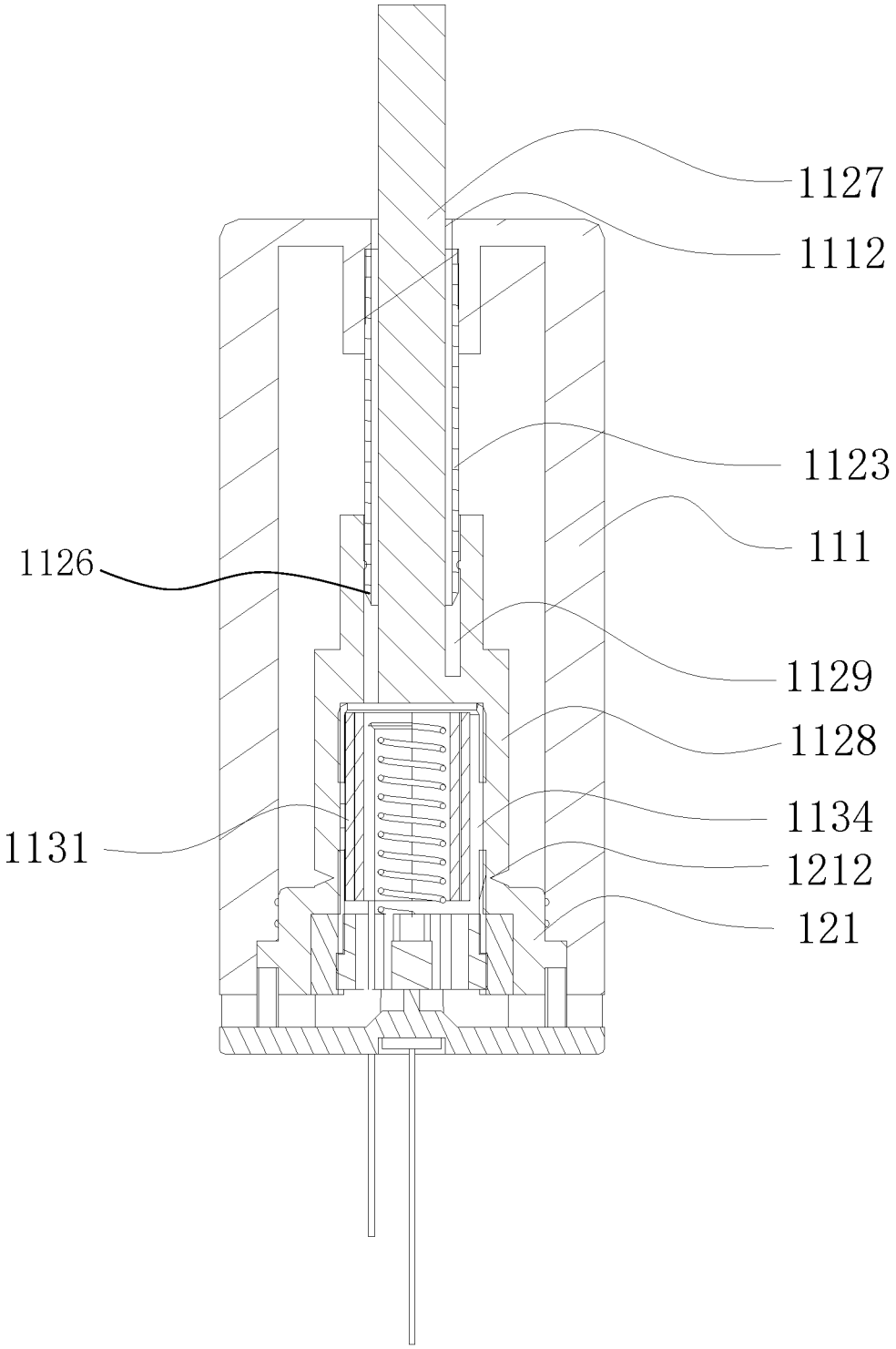
FIG. 9 is a schematic structural diagram of the cartridge shown in FIG. 8 in one state.
Figure 10:
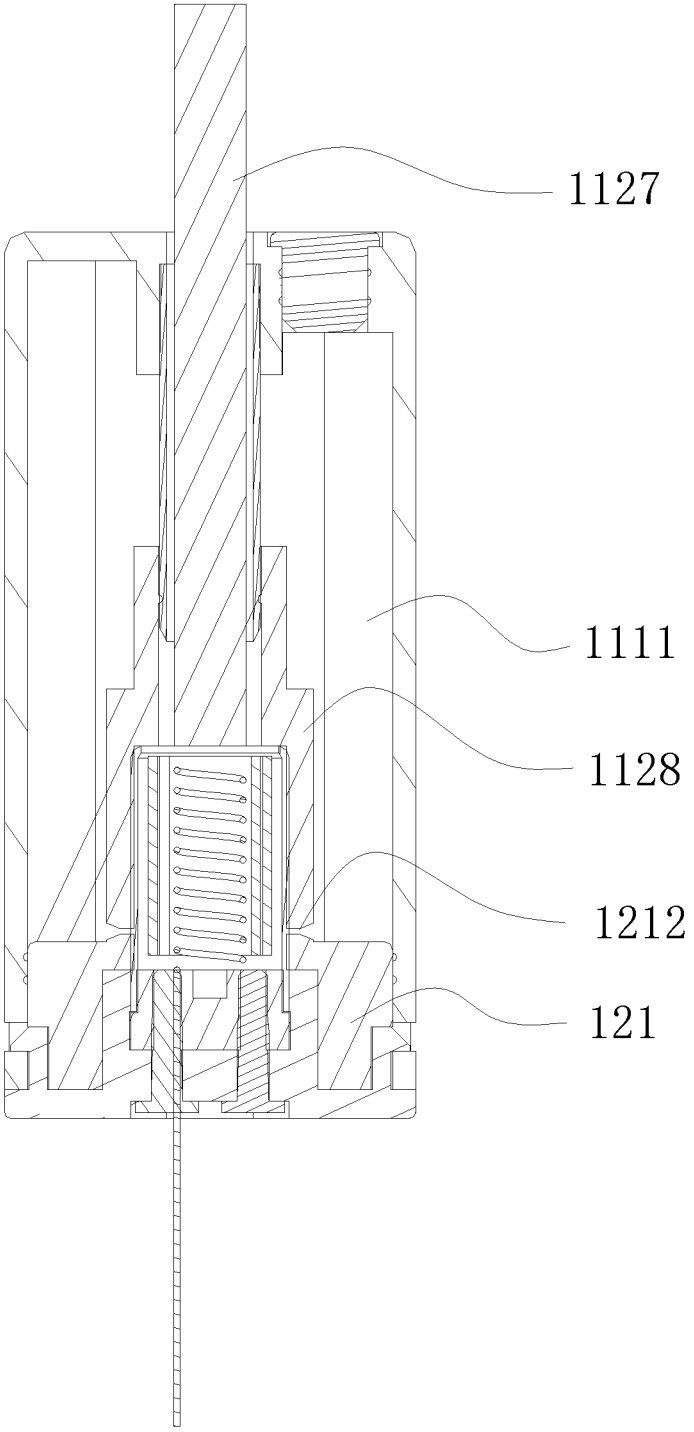
FIG. 10 is a schematic structural diagram of the cartridge shown in FIG. 8 in another state.
Figure 11:
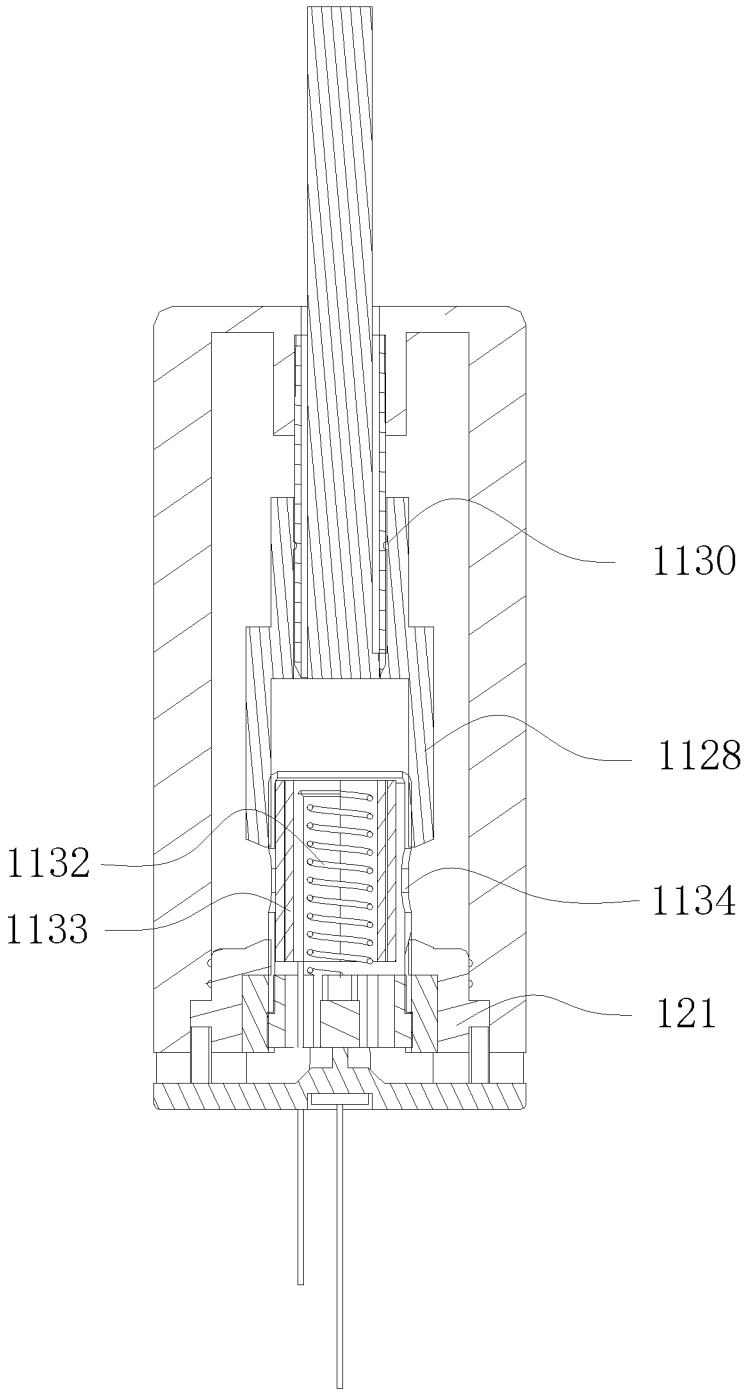
FIG. 11 is a schematic structural diagram of the cartridge shown in FIG. 8 in a further state.

Referring to FIGS. 2, 6 and 7, the isolation guiding tube 1121 is made of stainless steel. It can be understood that, in other embodiments not shown, the isolation guiding tube 1121 may also be made of titanium alloy or other materials with high hardness. The inner cavity of the isolation guiding tube 1121 is in communication with the vent hole 1112. The isolation guiding tube 1121 includes a connecting pipe 1123 abutting against the inner surface of the limiting portion 1115, and a receiving portion 1124 connected to a lower end of the connecting pipe 1123. The receiving portion 1124 extends radially outwards from the connecting pipe 1123 and then extends downwards. The connecting pipe 1123 and the receiving portion 1124 are each cylindrical. The receiving portion 1124 divides the connecting pipe 1123 into a connecting section 1125 connected with the limiting portion 1115 and a cutting portion 1126 capable of resisting the movable tube 1122.

In this embodiment, the outer surface of the connecting section 1125 and the inner surface of the limiting portion 1115 are connected by an interference fit, and the upper end of the connecting section 1125 abuts against the inner wall of the cartridge shell 111. It can be understood that, in other embodiments not shown, the connecting section 1125 may also be integrally formed with the limiting portion 1115. Or optionally, the limiting portion 1115 may be omitted, and when the limiting portion 1115 is omitted, the connecting section 1125 and the cartridge shell 111 are integrally formed, as long as the inner cavity of the connecting section 1125 is in communication with the vent hole 1112.

Please refer to FIGS. 2-7 again, the movable tube 1122 is made of silicone material. It can understood that, in other embodiments not shown, the movable tube 1122 may also be made of soft materials such as rubber or plastic. The movable tube 1122 includes an operating portion 1127 located in the connecting pipe 1123 and extending out of the cartridge shell 111 from the vent hole 1112, and a shielding portion 1128 connected to the lower end of the operating portion 1127 corresponding to the inner cavity of the receiving portion 1124. The axial length of the operating portion 1127 is greater than the axial length of the connecting pipe 1123. The upper end of the shielding portion 1128 is provided with a cutting groove 1129 corresponding to the cutting portion 1126 around the periphery of the operating portion 1127. The outer surface of the shielding portion 1128 is protruded to form an abutting portion 1130 along the circumferential direction of the shielding portion 1128. The user can upwardly pull the upper end of the operating portion 1127 that is extended to the outside of the vent hole 1112 to drive the shielding portion 1128 to move upwards. When the inner bottom wall of the cutting groove 1129 gradually resists the cutting portion 1126, the abutting portion 1130 gradually resists the inner surface of the receiving portion 1124. Since the upper end of the shielding portion 1128 is provided with a cutting groove 1129 corresponding to the cutting portion 1126 around the periphery of the operating portion 1127, the connection between the shielding portion 1128 and the operating portion 1127 is relatively fragile. When the inner bottom wall of the cutting groove 1129 completely resists the cutting portion 1126, the user can continue to pull the operating portion 1127 upwards so that the operating portion 1127 is separated from the shielding portion 1128; at this time, the abutting portion 1130 resists the inner surface of the receiving portion 1124, so that the shielding portion 1128 can be fixed relative to the receiving portion 1124 under the action of the resisting force. In this embodiment, the cutting groove 1129 is designed to be annular for convenient processing.

It can be understood that, in other embodiments not shown, only the shielding portion 1128 is made of a soft material such as silicone. The soft material has good wrapping properties, and can better wrap the atomizing shell 1131, so as to better shield the liquid inlet hole 1134. The operating portion 1127 and the shielding portion 1128 are detachably connected, for example, the operating portion 1127 is connected to the upper end of the shielding portion 1128 by threads. Correspondingly, when it needs to expose the liquid inlet hole 1134, the operating portion 1127 is pulled upwards firstly. The cutting groove 1129 is non-continuous, for example, it has one, two or three arc-shaped groove segments, and the cutting portion 1126 matching with the non-continuous cutting groove 1129 is also set to be non-continuous, it only needs to ensure that when the shielding portion 1128 moves upward under the driving of the operating portion 1127 and resists the upper end of the receiving portion 1124, the cutting portion 1126 can insert into the cutting groove 1129. Since both of the cutting portion 1126 and the cutting groove 1129 are non-continuous, and the connecting pipe 1123 cannot be rotated or requires a greater force to rotate, the operating portion 1127 can be separated from the shielding portion 1128 by continuing to rotate the operating portion 1127. The operating portion 1127 can be recycled and reused, reducing pollution and reducing costs.

It can be understood that, in other embodiments not shown, the shielding portion 1128 and the operating portion 1127 can be detachably connected. The detachable connection includes but not limited to a snapping connection, a plugging connection, etc. In this situation, the cutting groove 1129 can be omitted. When the cutting groove 1129 is omitted, the user pulls the operating portion 1127 upward, and the operating portion 1127 drives the shielding portion 1128 to move upward, and the upper end of the shielding portion 1128 can directly resist the cutting portion 1126; when the user continues to pull the operating portion 1127 upwards, the operating portion 1127 can be separated from the shielding portion 1128. Or optionally, both the cutting groove 1129 and the cutting portion 1126 can be omitted. When the cutting groove 1129 and the cutting portion 1126 are omitted, the user pulls the operating portion 1127 upward to drive the shielding portion 1128 to move upward, and the upper end of the shielding portion 1128 gradually resists the inner surface of the receiving portion 1124; when the upper end of the shielding portion 1128 completely resists against the inner surface of the receiving portion 1124, the user can continue to pull the operating portion 1127 upward to separate the operating portion 1127 from the shielding portion 1128.

It can be understood that, in other embodiments not shown, a groove (not shown) is provided on the inner wall of the receiving portion 1124. When the user pulls the operating portion 1127 upward to drive the shielding portion 1128 to move upward, the abutting portion 1130 can engage in the groove, so that the shielding portion 1128 is more firmly fixed in the receiving portion 1124. Or optionally, the abutting portion 1130 can be omitted. When the abutting portion 1130 is omitted, the inner wall of the receiving portion 1124 is provided with a protrusion, when the user pulls the operating portion 1127 upwards to drive the shielding portion 1128 to move upward, the protrusion can resist against the outer surface of the shielding portion 1128, so that the shielding portion 1128 can be fixed relative to the receiving portion 1124 under the action of the resisting force. Or optionally, the shielding portion 1128 is further provided with a latching slot (not shown), when the user pulls the operating portion 1127 upwards to drive the shielding portion 1128 to move upwards, the protrusion can engage in the latching slot, so that the shielding portion 1128 is more firmly fixed in the receiving portion 1124.

The atomizing structure 113 includes an atomizing shell 1131 received in the shielding portion 1128, and a heating member 1132 and a liquid absorbing member 1133 installed in the atomizing shell 1131. The liquid absorbing member 1133 engages with the heating member 1132. For example, the liquid absorbing member 1133 is wrapped around the heating member 1132, and the liquid absorbing member 1133 is interposed between the atomizing shell 1131 and the heating member 1132.

The atomizing shell 1131 is open at both ends, and the side wall of the atomizing shell 1131 is provided with a liquid inlet hole 1134. After the shielding portion 1128 moves upward, the liquid inlet hole 1134 is in communication with the liquid storage chamber 1111. Specifically, pulling the operating portion 1127 upwards by the user can irreversibly switch the shielding portion 1128 from a first state to a second state; in the first state, the shielding portion 1128 is sleeved on the atomizing shell 1131 to shield the liquid inlet hole 1134 of the atomizing shell 1131, and the liquid inlet hole 1134 is isolated from the liquid storage chamber 1111; in the second state, the shielding portion 1128 and the operating portion 1127 are separated, the shielding portion 1128 moves relative to the atomizing housing 1131 to expose the liquid inlet hole 1134, and the liquid inlet hole 1134 is in communication with the liquid storage chamber 1111. It can be understood that, in this embodiment, "irreversibly" means that, after the shielding portion 1128 is switched from the first state to the second state, the shielding portion 1128 can no longer be switched from the second state to the first state.

The atomizing shell 1131 further provides an atomizing chamber (not labeled) therein, and the atomizing chamber is in communication with the vent hole 1112. For example, in this embodiment, the heating member 1132 is a cylindrical spiral heating wire, the inner cavity of the cylindrical spiral heating wire forms the atomizing chamber, and the smoke formed by heating the e-liquid by the heating member 1132 is mainly formed in the atomizing chamber.

The liquid absorbing member 1133 is made of cotton, cotton cloth, porous ceramics, or other materials that can easily absorb liquid. The liquid absorbing member 1133 can gradually absorb the e-liquid, and gradually transfer the absorbed e-liquid to the heating member 1132, so that the heating member 1132 heats and atomizes the e-liquid absorbed by the liquid absorbing member 1133.

Referring to FIGS. 2 and 6, the sealing structure 12 includes a cartridge plug 121 received in the cartridge shell 111 and sleeved on the atomizing shell 1131, a tail cap 122 connected to the cartridge plug 121, an airway plug 123 disposed in the tail cap 122, and electrode contact members 124 mounted to the tail cap 122 for connecting to the battery device.

The cartridge plug 121 is made of silicone material. It can be understood that, in other embodiments not shown, the cartridge plug 121 also may be made of a material with good sealing properties such as rubber. A receiving hole 1211 corresponding to the atomizing shell 1131 is defined in the cartridge plug 121. The cartridge plug 121 constitutes the bottom wall of the liquid storage chamber 1111.

Please refer to FIG. 2 again, the tail cap 122 includes a base 1221 provided at the lower end of the cartridge shell 111 and a cap body 1222 provided on the base 1221 and connected to the cartridge plug 121. The base 1221 is provided with a plurality of cutouts 1223 in communication with the air inlet hole 1114, the cap body 1222 is located in the cartridge plug 121, and the cap body 1222 is provided with a plurality of guiding holes (not shown) in communication with the cutouts 1223.

The airway plug 123 is received in the cap body 1222. The airway plug 123 is provided with a plurality of airway holes 1231 in communication with the atomizing chamber and the guiding holes. The external air can enter the atomizing chamber through the air inlet hole 1114, the cutouts 1223, the guiding holes and the airway holes 1231 in sequence, so that the external air can be mixed with the smoke in the atomizing chamber.

In this embodiment, there are two electrode contact members 124, and the two electrode contact members 124 are installed to the base 1221 at intervals. When the two electrode contact members 124 are respectively connected to the positive electrode and the negative electrode of the battery device, the electronic cigarette is activated and the circuit is turned on.

Installation process: the atomizing shell 1131 is mounted in the shielding portion 1128, the cartridge plug 121 is sleeved at the lower end of the atomizing shell 1131, so that the liquid inlet hole 1134 is shielded by the shielding portion 1128; the liquid absorbing member 1133 and the heating member 1132 are mounted in the atomizing shell 1131, the airway plug 123 is mounted in the cap body 1222, the cap body 1222 is received in the cartridge plug 121, and the base 1221 is mounted at the lower end of the cartridge shell 111; finally, the operating portion 1127 is inserted into the connecting pipe 1123 and extends to the outside from the vent hole 1112; at this time, the air inlet hole 1114, the cutouts 1223, the guiding holes, the airway holes 1231 and the atomizing chamber are in communication with each other; the battery device is installed on the cartridge 10, so that the two electrode contact members 124 are respectively connected to the positive and negative electrodes of the battery device.

In use: when injecting liquid, the user can inject liquid into the liquid storage chamber 1111 through the liquid injection hole 1113. After the user finishes filling, the e-liquid plug 1116 is mounted in the liquid injection hole 1113, the e-liquid plug 1116 can seal the liquid injection hole 1113 and prevent the e-liquid in the liquid storage chamber 1111 from leaking.

When the user does not use the cartridge 10, the liquid inlet hole 1134 is shielded by the shielding portion 1128, and the liquid inlet hole 1134 is isolated from the liquid storage chamber 1111. When the user uses the cartridge 10, the user can upwardly pull the upper end of the operating portion 1127 that is extended to the outside of the vent hole 1112 to drive the shielding portion 1128 to move upward. When the inner bottom wall of the cutting groove 1129 gradually resists the cutting portion 1126, the abutting portion 1130 gradually resists the inner surface of the receiving portion 1124. Since the upper end of the shielding portion 1128 is provided with a cutting groove 1129 corresponding to the cutting portion 1126 around the periphery of the operating portion 1127, the connection between the shielding portion 1128 and the operating portion 1127 is relatively fragile. When the inner bottom wall of the cutting groove 1129 completely resists the cutting portion 1126, the user can continue to pull the operating portion 1127 upward so that the operating portion 1127 can be separated from the shielding portion 1128; at this time, the abutting portion 1130 completely resists the inner surface of the receiving portion 1124, so that the shielding portion 1128 can be fixed relative to the receiving portion 1124 under the action of the resisting force, the shielding portion 1128 no longer shields the liquid inlet hole 1134 or shields part of the liquid inlet hole 1134, the liquid inlet hole 1134 is in communication with the liquid storage chamber 1111, the e-liquid in the liquid storage chamber 1111 can enter the atomizing shell 1131 through the liquid inlet hole 1134, the e-liquid is gradually absorbed by the liquid absorbing member 1133 in the atomizing shell 1131, and the absorbed e-liquid is gradually transferred to the heating member 1132.

When inhaling, the electronic cigarette is powered on, the positive and negative electrodes of the battery device are respectively connected to the two electrode contact members 124, the circuit of the electronic cigarette is turned on, the heating member 1132 starts to heat and atomize the e-liquid absorbed by the liquid absorbing member 1133; the external air can enter the atomizing chamber through the air inlet hole 1114, the cutouts 1223, the guide holes and the airway holes 1231 in sequence, so that the external air is mixed with the smoke in the atomizing chamber, and the user can inhale the smoke via the vent hole 1112.

Second Embodiment

Please refer to FIGS. 8-11 at the same time, the main difference between the cartridge 10 provided in the second embodiment and the cartridge 10 in the first embodiment is as follows. The cartridge plug 121 and the lower end of the shielding portion 1128 are integrally formed. An annular cut 1212 is formed along the circumference of the shielding portion 1128 at the junction of the cartridge plug 121 and the shielding portion 1128. When the user upwardly pulls the upper end of the operating portion 1127 that is extended to the outside of the vent hole 1112, the operating portion 1127 drives the shielding portion 1128 to move upward. After the operating portion 1127 drives the shielding portion 1128 to move upward for a certain distance, since the junction between the cartridge plug 121 and the shielding portion 1128 is provided with an annular cut 1212, the connection between the cartridge plug 121 and the shielding portion 1128 is relatively fragile, the cartridge plug 121 is gradually separated from the shielding portion 1128. When the inner bottom wall of the cutting groove 1129 gradually resists the lower end of the connecting pipe 1123, the abutting portion 1130 gradually resists the outer surface of the connecting pipe 1123. Since the upper end of the shielding portion 1128 is provided with a cutting groove 1129 corresponding to the cutting portion 1126 around the periphery of the operating portion 1127, the connection between the shielding portion 1128 and the operating portion 1127 is relatively fragile. When the inner bottom wall of the cutting groove 1129 completely resists the connecting pipe 1123, the user can continue to pull the operating portion 1127 upwards to separate the operating portion 1127 from the shielding portion 1128. At this time, the abutting portion 1130 completely resists the outer surface of the connecting pipe 1123, and the shielding portion 1128 can be fixed relative to the connecting pipe 1123 under the action of the resisting force, the liquid inlet hole 1134 is in communication with the liquid storage chamber 1111, the e-liquid in the liquid storage chamber 1111 can enter the atomizing shell 1131 through the liquid inlet hole 1134, the e-liquid is gradually absorbed by the liquid absorbing member 1133 in the atomizing shell 1131, and the absorbed e-liquid is gradually transferred to the heating member 1132.

In this embodiment, the receiving portion 1124 is omitted. When the user upwardly pulls the upper end of the operating portion 1127 that is extended to the outside of the vent hole 1112, the operating portion 1127 drives the shielding portion 1128 to move upward, the inner bottom wall of the cutting groove 1129 gradually resists the lower end of the cutting portion 1126, the abutting portion 1130 gradually resists the outer surface of the cutting portion 1126. When the inner bottom wall of the cutting groove 1129 completely resists the cutting portion 1126, the user can continue to pull the operating portion 1127 upwards so that the operating portion 1127 is separated from the shielding portion 1128. At this time, the abutting portion 1130 completely resists the outer surface of the cutting portion 1126, the shielding portion 1128 can be fixed relative to the connecting pipe 1123 under the action of the resisting force.

It can be understood that, in other embodiments not shown, a sliding rail (not shown) is provided on the inner surface of the connecting section of the cartridge plug 121 and the shielding portion 1128, the outer wall of the atomizing shell 1131 is provided with a sliding slot (not shown) corresponding to the sliding rail. When the cartridge 10 is not in use, the slide rail is located in the sliding slot. With the cooperation of the sliding rail and the sliding slot, the cartridge plug 121 and the shielding portion 1128 remain relatively fixed. When the user upwardly pulls the upper end of the operating portion 1127 that is extended to the outside of the vent hole 1112, the sliding rail gradually separates from the sliding slot, so that the cartridge plug 121 and the shielding portion 1128 are gradually separated from each other. It can be understood that, in other embodiments not shown, it only requires that the user can upwardly pull the upper end of the operating portion 1127 that is extended to the outside of the vent hole 1112, the operating portion 1127 can drive the shielding portion 1128 to move upward for a certain distance, and the cartridge plug 121 can be gradually separated from the shielding portion 1128.

In the electronic cigarette of the present disclosure, since the movable structure 112 includes an isolation guiding tube 1121 received in the cartridge shell 111 and a movable tube 1122 at least partially disposed in the isolation guiding tube 1121, the movable tube 1122 includes an operating portion 1127 and a shielding portion 1128, the operating portion 1127 is received in the isolation guiding tube 1121 and one end of the operating portion 1127 extends out from the vent hole 1112, the atomizing structure 113 is provided with a liquid inlet hole 1134 capable of being communicated with the liquid storage chamber 1111, the shielding portion 1128 is movably sleeved on the atomizing structure 113 to shield or expose the liquid inlet hole 1134, so that the liquid inlet hole 1134 is isolated from or in communication with the liquid storage chamber 1111. When the user does not use the electronic cigarette, the shielding portion 1128 is sleeved on the atomizing shell 1131 to shield the liquid inlet hole 1134.

When the user uses the electronic cigarette, the shielding portion 1128 and the operating portion 1127 are separated, and the shielding portion 1128 moves relative to the atomizing shell 1131 to expose the liquid inlet hole 1134, so that the liquid inlet hole 1134 is in communication with the liquid storage chamber 1111. The electronic cigarette of the present disclosure can realize the isolation of the e-liquid from the cotton when the user does not use the electronic cigarette, thereby facilitating the storage of the e-liquid.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. A cartridge, comprising:

a cartridge shell; and a movable structure and an atomizing structure received in the cartridge shell;

wherein an inner cavity of the cartridge shell forms a liquid storage chamber, the cartridge shell is provided with a vent hole, the movable structure comprises an isolation guiding tube received in the cartridge shell and a movable tube at least partially disposed in the isolation guiding tube, the movable tube comprises an operating portion and a shielding portion connected to a lower end of the operating portion, the operating portion is located in the isolation guiding tube, an upper end of the operating portion extends out from the vent hole and is configured for user to pull the operating portion upwardly, the atomizing structure is provided with a liquid inlet hole capable of being communicated with the liquid storage chamber, the shielding portion is movably sleeved on the atomizing structure to shield or expose the liquid inlet hole, to cause the liquid inlet hole to be isolated from or in communication with the liquid storage chamber; and when the user upwardly pulls the upper end of the operating portion that is extended to an outside of the vent hole, the shielding portion is driven by the operating portion to move upwards and switch from a first position to a second position; in the first position, the liquid inlet hole is shielded by the shielding portion and the liquid inlet hole is isolated from the liquid storage chamber; in the second position, the liquid inlet hole is exposed and the liquid inlet hole is in communication with the liquid storage chamber;

the isolation guiding tube comprises a connecting pipe abutting against an inner wall of the cartridge shell and a receiving portion connected to a lower end of the connecting pipe, the receiving portion extends radially outwards from the connecting pipe and then extends downwards, an inner cavity of the connecting pipe is in communication with the vent hole.

2. The cartridge according to claim 1, wherein the atomizing structure comprises an atomizing shell, and a heating member and a liquid absorbing member received in the atomizing shell, the liquid inlet hole is defined in the atomizing shell, e-liquid is absorbed by the liquid absorbing member from the liquid inlet hole and supplied to the heating member.

3. The cartridge according to claim 1, wherein the shielding portion is provided with a cutting groove, and the isolation guiding tube is provided with a cutting portion facing the cutting groove and matching with the cutting groove.

4. The cartridge according to claim 1, wherein the vent hole is provided at an upper end of the cartridge shell, the operating portion is received in the connecting pipe, and the upper end of the operating portion extends out of the cartridge shell from the vent hole.

5. The cartridge according to claim 4, wherein a cutting portion is provided at a lower end of the connecting pipe, and a cutting groove is provided at an upper end of the shielding portion corresponding to the cutting portion, when the upper end of the operating portion is pulled to move upwardly, the operating portion drives the shielding portion to move upwards, an inner bottom wall of the cutting groove resists the cutting portion to separate the shielding portion from the operating portion.

6. The cartridge according to claim 5, wherein the shielding portion is received in the receiving portion after the shielding portion is separated from the operating portion.

7. The cartridge according to claim 6, wherein an outer surface of the shielding portion is protruded to form an abutting portion, the abutting portion resists an inner surface of the receiving portion so as to fix the shielding portion relative to the receiving portion after the shielding portion is separated from the operating portion.

8. The cartridge according to claim 4, wherein an inner wall of the cartridge shell adjacent to the vent hole protrudes downwardly along an axial direction of the cartridge shell to form a limiting portion, the connecting pipe is at least partially disposed in the limiting portion and abuts against an inner surface of the limiting portion.

9. The cartridge according to claim 1, wherein the cartridge further comprises a scaling structure, the sealing structure comprises a cartridge plug connected to one end of the cartridge shell, the cartridge plug seals one end of the liquid storage chamber, the atomizing structure is at least partially disposed on the cartridge plug.

10. The cartridge according to claim 9, wherein the sealing structure further comprises a tail cap connected to the cartridge plug, an airway plug received in the tail cap, and electrode contact members mounted to the tail cap, the cartridge plug is sleeved on the atomizing shell and connected to the shielding portion.

11. An electronic cigarette, comprising:

a battery device; and a cartridge according to claim 1, the cartridge being electrically connected to the battery device.

12. A cartridge, comprising:

a cartridge shell; and a movable structure and an atomizing structure received in the cartridge shell;

wherein an inner cavity of the cartridge shell forms a liquid storage chamber, the cartridge shell is provided with a vent hole, the movable structure comprises an isolation guiding tube received in the cartridge shell and a movable tube at least partially disposed in the isolation guiding tube, the movable tube comprises an operating portion and a shielding portion connected to a lower end of the operating portion, the operating portion is located in the isolation guiding tube and one end of the operating portion extends out from the vent hole, the atomizing structure is provided with a liquid inlet hole capable of being communicated with the liquid storage chamber, the shielding portion is able to irreversibly switch from a first state to a second state by operating the operating portion;

in the first state, the shielding portion is sleeved on the atomizing structure to shield the liquid inlet hole of the atomizing structure, and the liquid inlet hole is isolated from the liquid storage chamber; and in the second state, the shielding portion and the operating portion are separated, the shielding portion moves relative to the atomizing structure to expose the liquid inlet hole, and the liquid inlet hole is in communication with the liquid storage chamber.

13. The cartridge according to claim 12, wherein the atomizing structure comprises an atomizing shell, and a heating member and a liquid absorbing member received in the atomizing shell, the liquid inlet hole is defined in the atomizing shell, e-liquid is absorbed by the liquid absorbing member from the liquid inlet hole and supplied to the heating member.

14. The cartridge according to claim 12, wherein the shielding portion is provided with a cutting groove, and the isolation guiding tube is provided with a cutting portion facing the cutting groove and matching with the cutting groove.

15. The cartridge according to claim 12, wherein the isolation guiding tube comprises a connecting pipe abutting against an inner wall of the cartridge shell and a receiving portion connected to a lower end of the connecting pipe, the receiving portion extends radially outwards from the connecting pipe and then extends downwards, an inner cavity of the connecting pipe is in communication with the vent hole.

16. The cartridge according to claim 12, wherein the cartridge further comprises a sealing structure, the sealing structure comprises a cartridge plug connected to one end of the cartridge shell, the cartridge plug seals one end of the liquid storage chamber, the atomizing structure is at least partially disposed on the cartridge plug.

17. The cartridge according to claim 16, wherein the sealing structure further comprises a tail cap connected to the cartridge plug, an airway plug received in the tail cap, and electrode contact members mounted to the tail cap, the cartridge plug is sleeved on the atomizing shell and connected to the shielding portion.

* * * * *